US009082324B1

(12) United States Patent
Brown et al.

(10) Patent No.: US 9,082,324 B1
(45) Date of Patent: Jul. 14, 2015

(54) SIGNAGE SUPPORT STRUCTURE AND SIGNAGE ASSEMBLY

(71) Applicant: The Meyers Printing Companies, Inc., Minneapolis, MN (US)

(72) Inventors: Glenn P. Brown, St. Michael, MN (US); Tyler James Grund, Richfield, MN (US); Bradley Ray Kimber, Saint Francis, MN (US)

(73) Assignee: The Meyers Printing Companies, Inc., Minneapolis, MN (US)

( * ) Notice: Subject to any disclaimer, the term of this patent is extended or adjusted under 35 U.S.C. 154(b) by 0 days.

(21) Appl. No.: 14/551,616

(22) Filed: Nov. 24, 2014

Related U.S. Application Data

(60) Provisional application No. 61/908,393, filed on Nov. 25, 2013.

(51) Int. Cl.
*G09F 7/18* (2006.01)

(52) U.S. Cl.
CPC ..... *G09F 7/18* (2013.01); *G09F 2007/1804* (2013.01); *G09F 2007/1813* (2013.01)

(58) Field of Classification Search
CPC ..... G09F 2007/1813; G09F 2007/1808; G09F 2007/1804; G09F 2007/1817; G09F 7/18; G09F 3/06; G09F 3/16; G09F 3/204; G09F 3/20; G09F 1/10; F21V 21/088; F21V 21/08
See application file for complete search history.

(56) References Cited

U.S. PATENT DOCUMENTS

| | | | | | |
|---|---|---|---|---|---|
| 1,536,900 | A * | 5/1925 | Lowe | 248/229.15 |
| 1,617,670 | A * | 2/1927 | Cyr | 248/227.1 |
| 2,743,075 | A * | 4/1956 | Johnson | 248/223.41 |
| 5,499,789 | A * | 3/1996 | Rose | 248/489 |
| 5,667,178 | A * | 9/1997 | Yang | 248/262 |
| 5,769,292 | A * | 6/1998 | Cucheran et al. | 224/324 |
| 6,357,079 | B1 * | 3/2002 | Hsu | 16/87 R |
| 6,370,741 | B1 * | 4/2002 | Lu | 24/523 |
| 6,375,140 | B1 * | 4/2002 | Shen | 248/251 |
| 2010/0288897 | A1 * | 11/2010 | Chang | 248/229.22 |
| 2012/0047784 | A1 * | 3/2012 | St. Denis | 40/607.13 |

* cited by examiner

*Primary Examiner* — Casandra Davis
(74) *Attorney, Agent, or Firm* — Nawrocki, Rooney & Silvertson, P.A.

(57) ABSTRACT

A device for securing a sign to a mullion is provided. The device includes first and second body portions, and a tensioner operatively uniting same. The first body portion is characterized by adjacent mullion receiving elements and a sign support structure. A first mullion receiving element includes a substantially planar member receivable adjacent a mullion face. A second mullion receiving element extends from the first mullion receiving element for tensioned engagement with a first lateral mullion surface of opposingly paired lateral mullion surfaces adjacent the mullion face. The sign support structure is spaced apart and extends from the first mullion receiving element so as to thereby delimit a channel passing between the sign support structure and the first mullion receiving element. The second device portion is slidingly receivable within the channel of the first device body portion and is characterized by a mullion receiving element for tensioned engagement with a second lateral mullion surface of opposingly paired lateral mullion surfaces adjacent the mullion face. The tensioner is operable to draw the mullion receiving element of the second body portion towards the second mullion receiving element of the first body portion.

18 Claims, 11 Drawing Sheets

SIGNAGE SUPPORT STRUCTURE AND SIGNAGE ASSEMBLY

This is a United States national patent application filed pursuant to 35 USC §111(a) claiming priority under 35 USC §120 of/to U.S. Pat. Appl. Ser. No. 61/908,393 filed Nov. 25, 2013 and entitled SIGNAGE SUPPORT STRUCTURE & SIGNAGE ASSEMBLY, the disclosure of which is hereby incorporated by reference in its entirety.

TECHNICAL FIELD

The present invention generally relates to devices, assemblies and methods for message conveyance, more particularly, to devices, assemblies and methods for the display of signage, more particularly still to such display characterized by a signage support structure amenable to selective affixation to a window mullion for support of a variety of signage which is readily and easily changed out in relation to the support structure.

BACKGROUND OF THE INVENTION

Messaging is critical for businesses. Moreover, responsiveness is increasingly advantageous. With the advent and ubiquitousness of social media, avenues of consumer communication are more congested than ever.

Be that as it may, traditional point of purchase/sale displays and retail messaging remain a critical mechanism by which to garner consumer attention and leverage the goodwill of a brand, a special promotion, and/or other consumer directed message or communique. A need remains for snappy signage, namely point of purchase (POP) graphics. Such signage, whether text, graphics, images or a combination/subcombination thereof, can have a relative short shelf-life.

In the context of brick-and-mortar site signage, more particularly, window lettering and graphics, maintaining the freshness of messaging is important, arguably as important as maintaining the freshness of virtual messaging, however, it is far more challenging, and certainly more expensive to achieve. Whether a single retail store, a chain of national stores, or a franchise with regional or national cache, there remains a desire to provide simple, low cost, easy-to-update signage for a storefront.

While signs per se, their creation and application in relation to retail storefronts, take many forms, notionally, the aim is to directly or indirectly support same via portions of the brick and mortar store, advantageously on a temporary basis. Needless to say, the traditional, tried-and-true approach of applying text and/or graphics directly upon or to a window or the like has its shortcomings. Improvements via a next generation approach are warranted, namely, an approach wherein signage is supported upon a fixture reversibly mounted/mountable to a window mullion or the like.

SUMMARY OF THE INVENTION

A device for securing a sign to a mullion is provided. The device advantageously but not exclusively includes first and second body portions, and a tensioner operatively uniting same.

The first body portion is characterized by adjacent mullion receiving elements and a sign support structure. A first mullion receiving element includes a substantially planar member receivable adjacent a mullion face. A second mullion receiving element extends from the first mullion receiving element for tensioned engagement with a first lateral mullion surface of opposingly paired lateral mullion surfaces adjacent the mullion face. The sign support structure is spaced apart and extends from the first mullion receiving element so as to thereby delimit a channel passing between the sign support structure and the first mullion receiving element.

The second device portion is slidingly receivable within the channel of the first device body portion and is characterized by a mullion receiving element for tensioned engagement with a second lateral mullion surface of opposingly paired lateral mullion surfaces adjacent the mullion face. The tensioner is operable to draw the mullion receiving element of the second body portion towards the second mullion receiving element of the first body portion. More specific features and advantages obtained in view of those features will become apparent with reference to the drawing figures and DETAILED DESCRIPTION OF THE INVENTION.

BRIEF DESCRIPTION OF THE DRAWINGS

The device, assembly, subassemblies, structures and/or elements disclosed directly or implicitly herein may be embodied in other specific forms without departing from the spirit or general characteristics thereof, some of which forms have been indicated. Thus, the features described and depicted herein/herewith are to be considered in all respects illustrative and non-limiting and non-restrictive, with the following brief description of the drawings and their content provided.

DETAILED DESCRIPTION OF THE INVENTION

Figure 1:
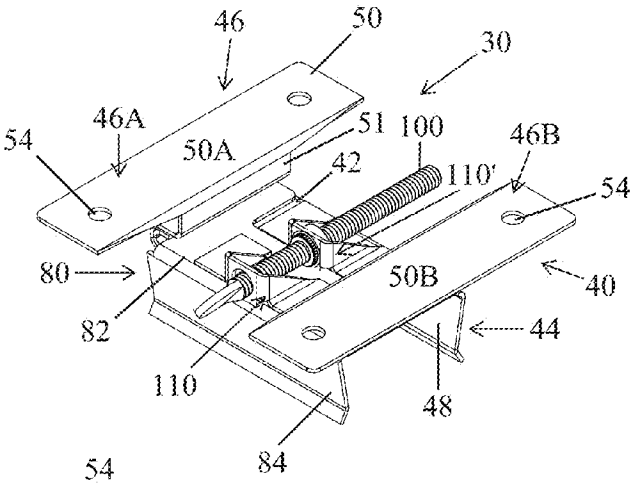
FIG. 1 depicts, perspective view overhead, a non-limiting device for securing a sign to a window mullion.
Figure 2:
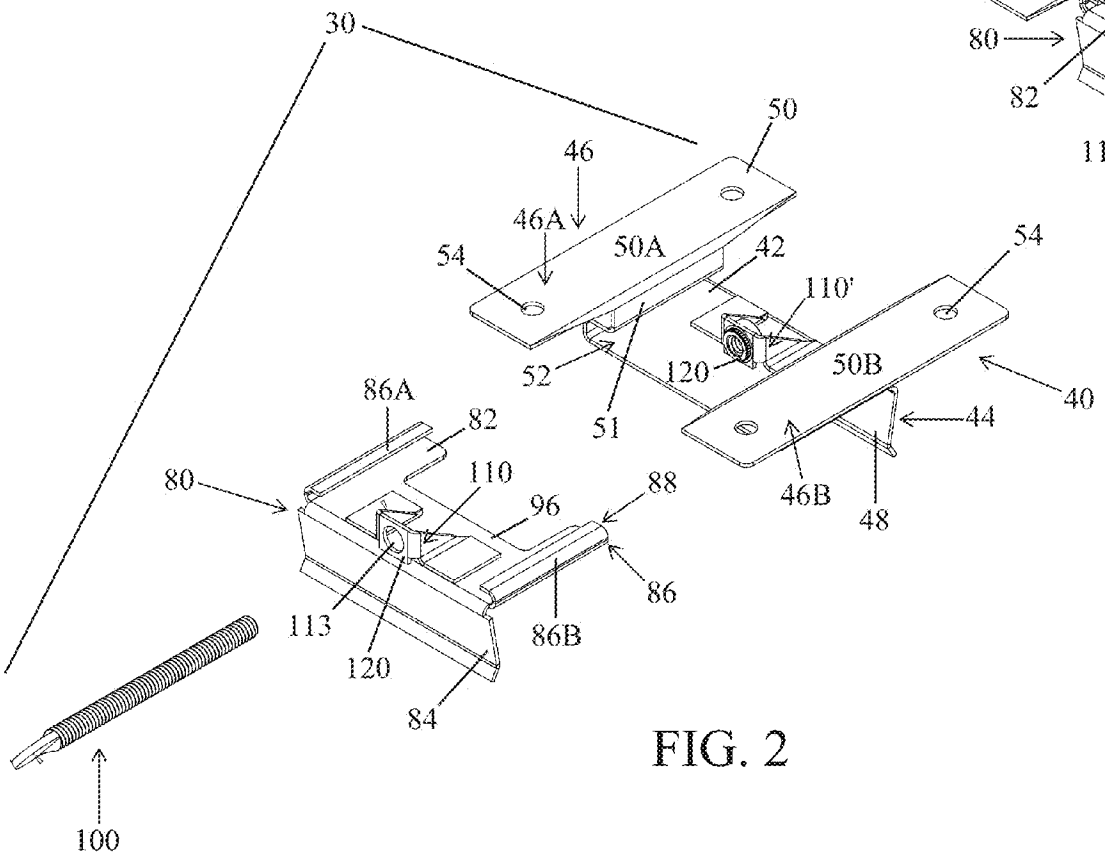
FIG. 2 depicts the device of FIG. 1 in an unassembled or disassociated state.
Figure 18:
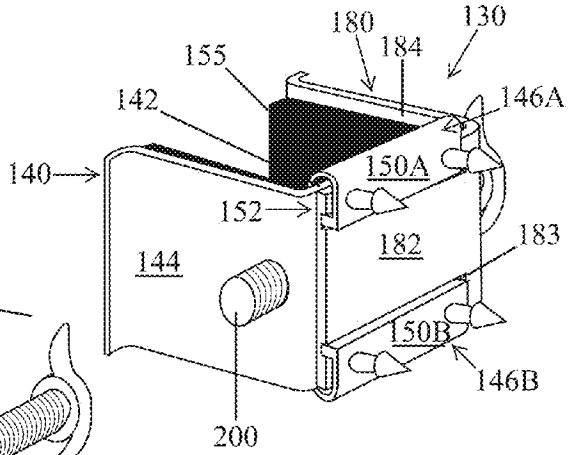
FIG. 18 depicts, side perspective view, a non-limiting alternate device for securing a sign to a window mullion.
Figure 19:
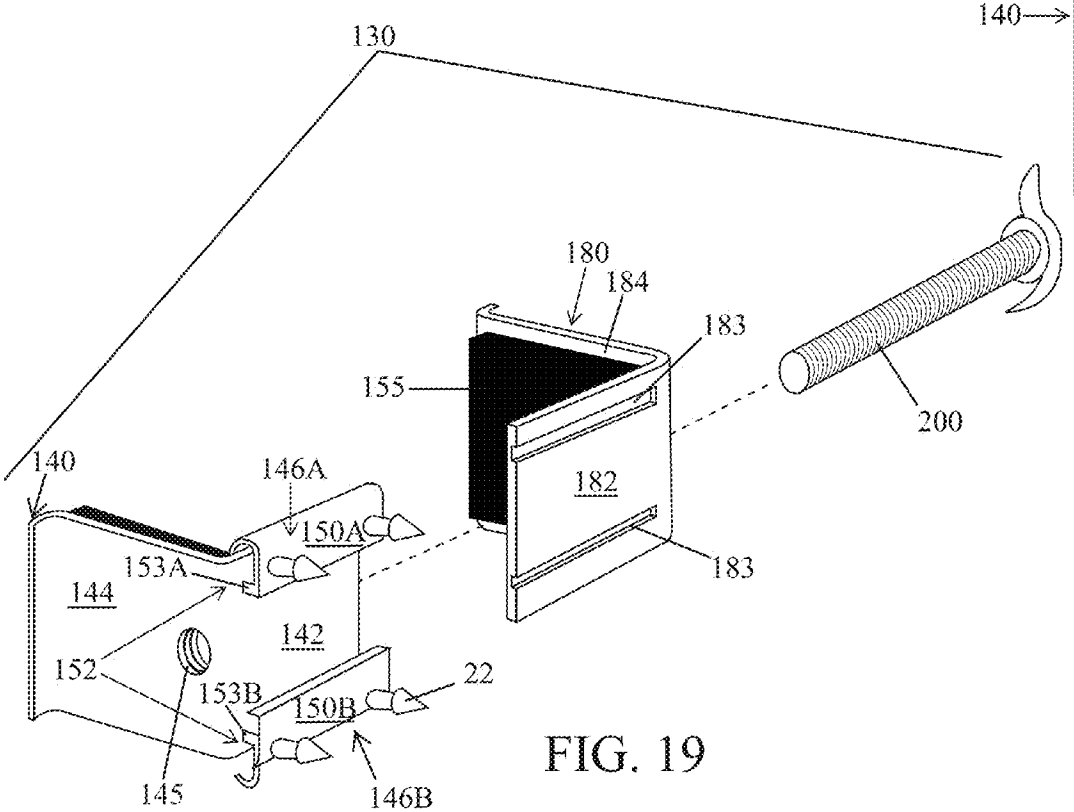
FIG. 19 depicts the device of FIG. 18 in an unassembled or disassociated state.

Variations on a theme are generally provided in connection to a signage support structure amenable to selective affixation to a mullion, window or otherwise, for support of a variety of signage which is readily and easily changed out in relation to the support structure. An advantageous, non-limiting device for securing a sign to a window mullion is depicted in FIGS. 1 & 2 and the several particularized component views of FIGS. 3-17. A further, a non-limiting alternate device for securing a sign to a window mullion is depicted in FIGS. 18 & 19, with signage systems characterized by the FIG. 18 device represented in FIGS. 20 & 21. Finally, still further, non-limiting alternate contemplated devices for securing a sign to a window mullion are depicted in each of FIGS. 22-25.

In advance of particulars, it is believed that some preliminary remarks will facilitate the detailed description. Notionally, a mullion or the like is intended to receive and retain one or more of Applicants' devices. In an architectural sense, a mullion is a vertical member between the casements or panes of a window or the panels of a screen. Commonly such member is characterized by a rectangular cross section, and whether an interior or exterior structure or element, it includes three visible surface portions, namely, a face (i.e., the planar surface spaced apart and generally parallel to the window glazing of a window mullion, or a panel or other planar element in a non-window mullion, mullion-like context) and opposed lateral surfaces, each adjacent the face (see e.g., either of FIG. 20 or 21 wherein a single lateral mullion surface is visible).

An advantageous signage system includes a device for no-tool affixation to the mullion, a portion thereof adapted to reversibly receive a sign or the like so as to be thereby supported. In its "simplest" form, the device may comprise a spring steel body which is manipulate for attachment to the mullion (e.g., the device of FIG. 25). Moreover, it is further contemplated and believed advantageous that the device be characterized by a body which is adapted such that a portion or portions be selectively drawn into engagement with the mullion (e.g., the devices of FIGS. 23 & 24). Finally, it is believed advantageous and preferable, but not necessary, to provide a device characterized by unitable first and second body portions and a tensioner or the like to establish and maintain a tensioned union of the body portions about a mullion segment. Contemplated, representative and non-limiting devices so styled are depicted in FIGS. 1, 2; FIGS. 18, 19; and, FIG. 22.

With general reference to FIGS. 1 & 2, there is shown a preferred, non-limiting device 30, assembled FIG. 1, unassembled FIG. 2, for securing a sign to a mullion or the like. The device, or assembly if you will, is advantageously characterized by first 40 and second 80 device body portions and a tensioner 100 for operative union of the device body portions about a mullion. Particularized views and/or depictions of first body portion 40 are presented in FIGS. 3-7, with particularized views and/or depictions of second body portion 80 presented in FIGS. 8-12. A tensioner guide or retainer 110, part-and-parcel of the preferred device body portions, is shown in isolation in FIGS. 13-17.

With continued general reference to FIGS. 1 & 2, first device body portion 40 may be fairly characterized as having adjacent mullion receiving elements, namely, a first mullion receiving element 42 and a second mullion receiving element 44, and a sign support structure 46, or structures (46*a*, 46*b*). First mullion receiving element 42 of the adjacent mullion receiving elements comprises a substantially planar member receivable upon a mullion face. Opposite a mullion face receiving surface 48 of first mullion receiving element 42 is an adapted tensioner guide or retainer 110' for operatively and cooperatively receiving and securing tensioner 100. Second mullion receiving element 44 of the adjacent mullion receiving elements extends from first mullion receiving element 42 for tensioned engagement with a first lateral mullion surface of opposingly paired lateral mullion surfaces adjacent the mullion face. Sign support structure 46 or structures 46*a*, 46*b*, which includes a sign receiving element 50 or elements (50*a*, 50*b*), is spaced apart and extends from first mullion receiving element 42 so as to thereby delimit a channel or guideway 52, passing between sign receiving element 50 of the sign support structure(s) 46 and first mullion receiving element 42, for sliding receipt of second device portion 80.

Second device body portion 80 is slidingly receivable within channel or guideway 52 of first device body portion 42 in furtherance of selectively positioning same in relation thereto and securing the body portions about the mullion. The second device body portion may be fairly characterized as having a base 82 from which angularly extends a mullion receiving element 84 for tensioned engagement with a second lateral mullion surface of opposingly paired lateral mullion surfaces adjacent the mullion face. Base 82 advantageously, but not necessarily, includes opposing in-turned side edges 86*a*, 86*b*, relative to each other, which, in combination, delimit a guide 88 which is receivable in guideway 52 of first body portion 42. Notionally, base 82 of second body portion 80 is guidingly received by the first mullion receiving element 42 of the first body portion 40 via cooperative sliding engagement of the guide 88 with the guideway 52 (i.e., and alternately, and fairly, it may be said that the guide 88 comprises opposing guide portions (i.e., left 88*a* and right 88*b*) for registration and receipt in corresponding opposing guideways (i.e., channels), left 52*a* and right 52*b*, of the guideway 52). Intermediate guide 88 of the base 82, and proximal to the mullion receiving element 84 of the second body portion 80, a tensioner guide or keeper 110 upwardly extends for receipt and passage of the tensioner 100 in furtherance of operative receipt of the tensioner by adapted tensioner guide 110' (i.e., a tensioner anchor structure) of the first mullion receiving element 42 of the first body portion 40, and thus a controlled advancement of one body portion in relation to the other body portion for a clamping engagement of the device about a mullion segment.

With general reference to the depictions of FIGS. 3-7, particulars for the preferred, non-limiting first device body portion is shown. Advantageously, but not exclusively, the device body portions are fabricated from 18 gauge steel/spring steel, more particularly, a single sheet (see e.g., FIG. 4 (first device body portion), or FIG. 9 (second device body portion)). Moreover, the device body portions advantageously but not necessarily include a vinyl coating. Further still, adaptation of mullion engaging surfaces of one or more of the body portions of the assembly is contemplated, e.g., via inclusion of a cushioning layer (see e.g., FIG. 18), to effectuate a non-marking interface for the assembly and the mullion, with a further functional aim, via the instant adaptation or otherwise, being a resilient interface for the assembly in relation to the mullion. Alternately, extruded plastic fabrication may prove advantageous and/or desirable as circumstances/applications warrant.

Figure 4:
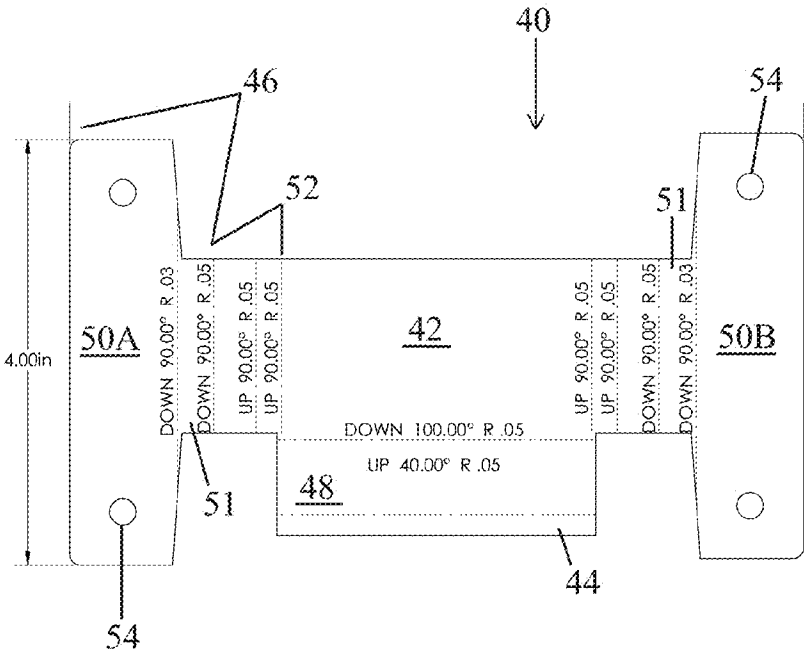
FIG. 4 depicts the FIG. 3 element in sheet form.
Figure 3:
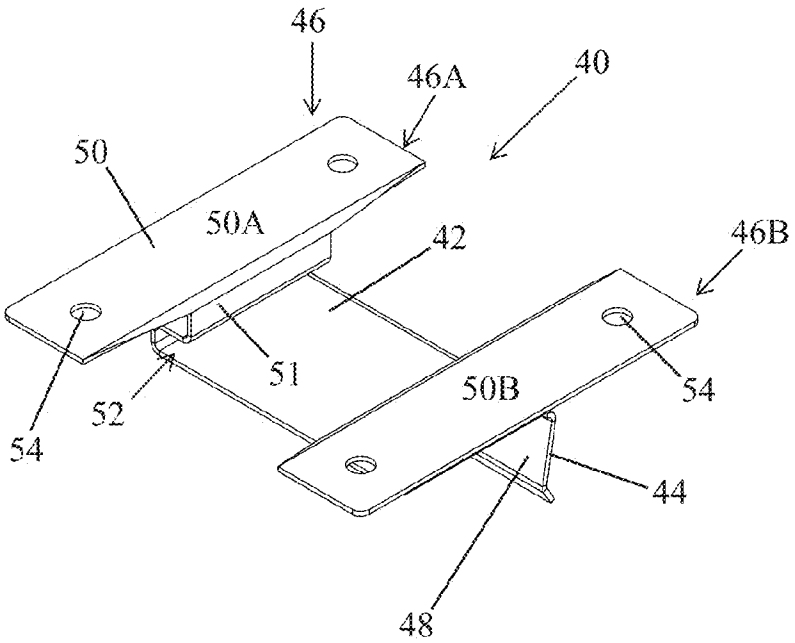
FIG. 3 substantially depicts the first device body portion of FIG. 2.

With particular reference to FIG. 4, a 2D representation of the first device body is provided. Contiguous first 42 and second 44 mullion receiving elements are disposed intermediate first and second sign receiving elements or element portions 50*a*, 50*b*, collectively, a sign receiving element 50. Material linking the central contiguous mullion receiving elements and the opposing sign receiving elements extend from opposing edges (i.e., lateral sides) of the first mullion receiving element and generally comprise portions or segments of the channel forming guideways 52*a*, 52*b*, and a portion of the sign support structure 46 (i.e., the sign support structure is generally characterized by the sign receiving element 50 (50*a*, 50*b*) and adjacent depending segment 51 which positions sign receiving element 50 in a spaced apart condition relative to and above the channel or guideway 52 (see FIG. 6). As indicated, each sign receiving element portion 50*a*, 50*b* includes apertures 54, or other adaptation, to receive hardware such as pins, rivets, etc. which facilitate union of the sign to the mullion supported device.

Figure 5:
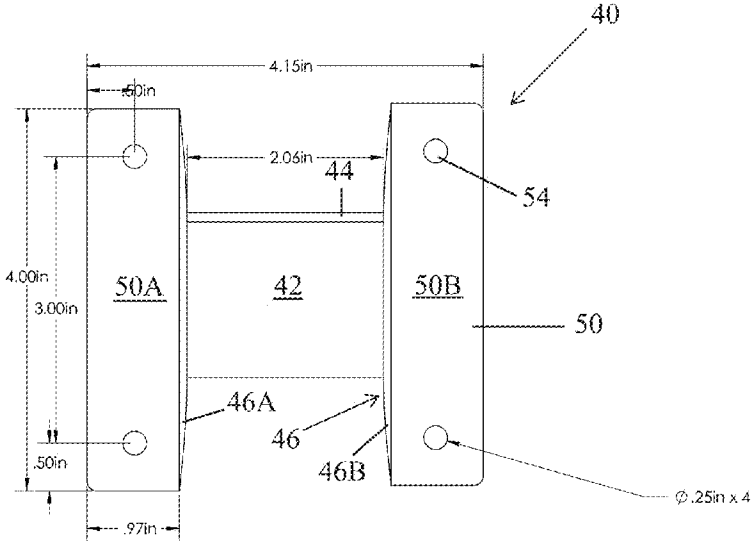
FIG. 5 depicts the FIG. 3 element in plan.
Figure 6:
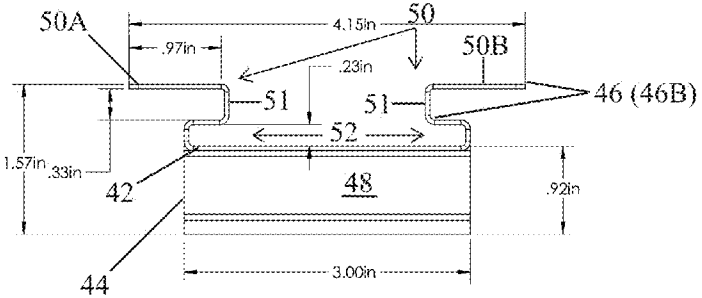
FIG. 6 depicts the FIG. 3 element in side elevation (i.e., an "open end" view.
Figure 7:
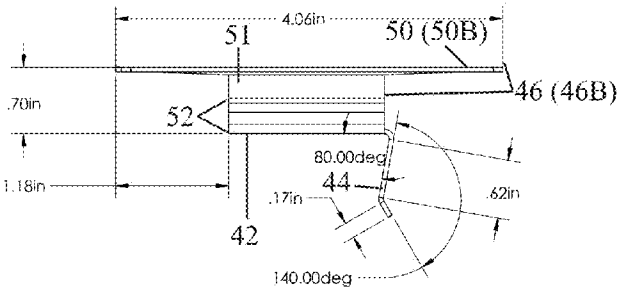
FIG. 7 depicts the FIG. 3 element in front elevation.

With general reference to FIGS. 5-7, the first device body portion is generally dimensioned to be approximately 4" by 4" in plan (FIG. 5), and about 1.5" in elevation (FIG. 6). The mullion receiving elements share a common dimension of about 3" front to back (FIG. 6), with the second mullion receiving element depending and extending from the first mullion receiving element at an angle of about 80° (FIG. 7) so as to extend therefrom by almost an inch. As indicated, the second mullion receiving portion includes a free end portion which outwardly extends at an angle of about 140° (FIG. 7).

The channel or guide of the first device body portion overlays the first mullion receiving element and upwardly extends therefrom by approximately a quarter of an inch (FIG. 6). The sign support structure upwardly extends from the channel by approximately a third of an inch (FIG. 6). It is advantageous to retain the sign or signage in a spaced apart condition relative to the mullion bracing elements as it is believed that the channel(s) and the vertical segments of the sign support structure impart resiliency for a supported sign or signage.

Figure 9:
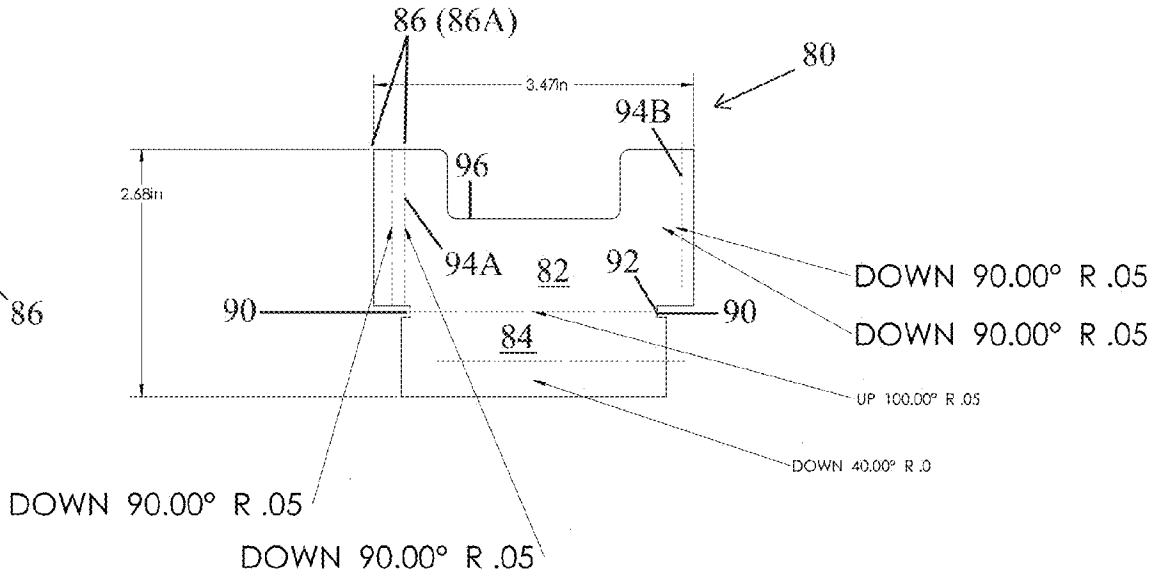
FIG. 9 depicts the FIG. 8 element in sheet form.
Figure 8:
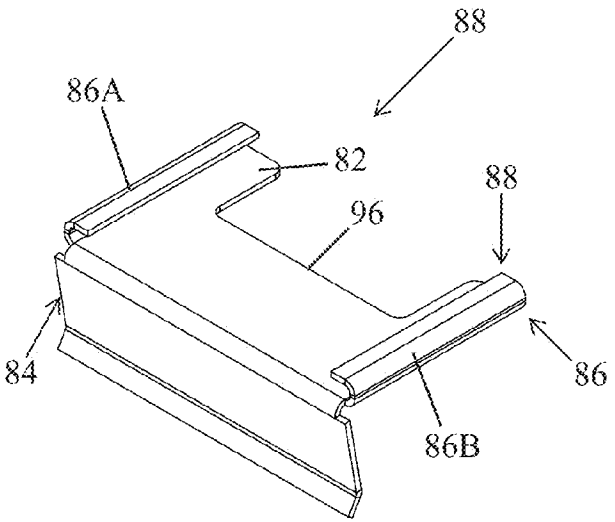
FIG. 8 substantially depicts the second device body portion of FIG. 2.
Figure 10:
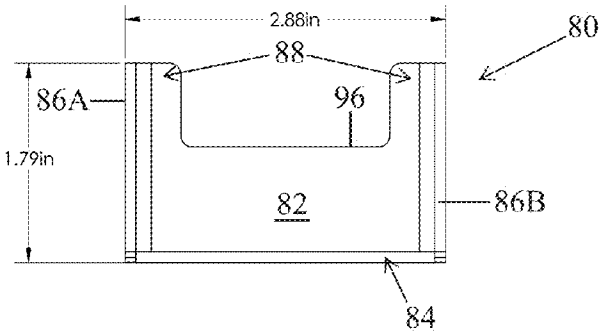
FIG. 10 depicts the FIG. 8 element in plan.
Figure 11:
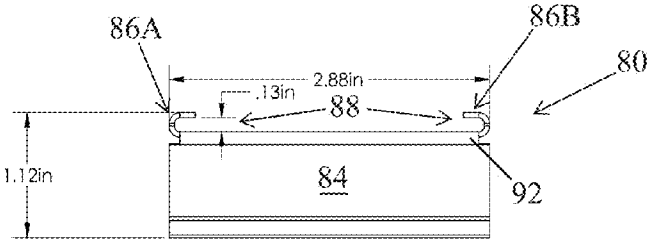
FIG. 11 depicts the FIG. 8 element in side elevation (i.e., a "closed end" view)
Figure 12:
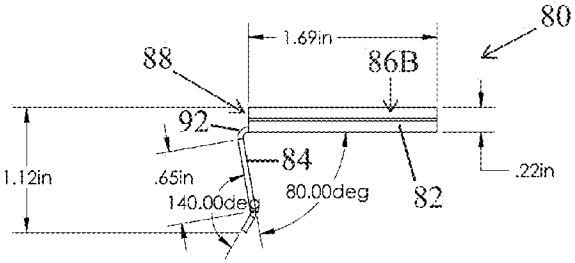
FIG. 12 depicts the FIG. 8 element in front elevation.
Figure 14:
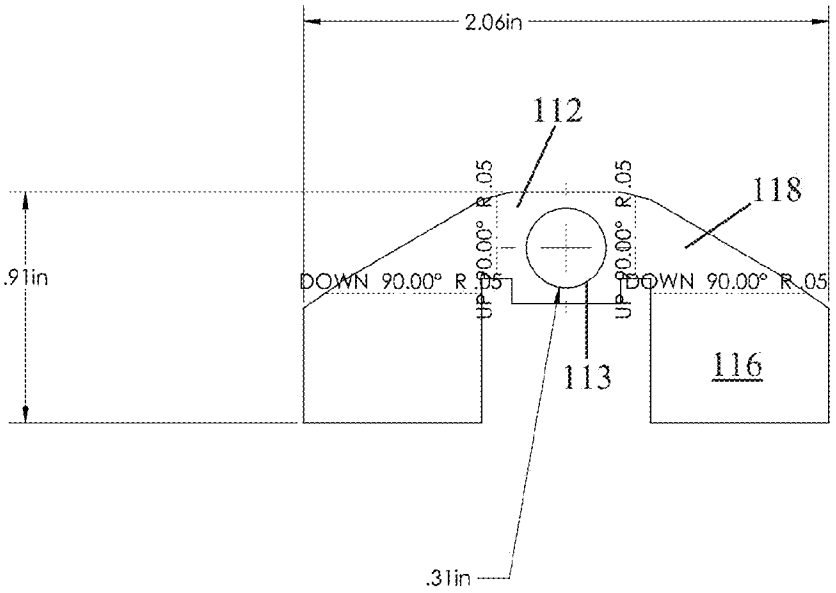
FIG. 14 depicts the FIG. 13 element in sheet form.

With general reference to the depictions of FIGS. 8-12, particulars for the preferred, non-limiting second device body portion 80 is shown, with a 2D representation thereof provided (FIG. 9). The base 82 and mullion receiving element 84 are as generally indicated, the latter depending from the former. Notched portions 90 intermediate the base 82 and mullion receiving element 84 correspond to a linking segment 92 (FIG. 8) for and between the base 82 and mullion receiving element 84. Opposing edges (i.e., lateral sides 94*a*, 94*b*) of the base 82 of the second device body portion 80 generally comprise portions or segments of the guides 88*a*, 88*b* receivable in the guideways 52*a*, 52*b* of the first device body portion 40. More particularly, these segments are manipulated to form the in-turned side edges 86*a*, 86*b* which delimit the guide 88 or guides 88*a*, 88*b* of the second device body portion 80. As is generally shown, the periphery of the base, more particularly, a longitudinal edge, includes a cut-out or recess 96 which permits a maximum union or receipt of the second device body portion 80 relative to the first device body portion 40 (i.e., a maximum overlap of, for, and/or between the base 82 and the first mullion receiving element 42 is enabled so as to thereby delimit a minimum mullion "capture" width (i.e., see the relationship of FIG. 1).

The second device body portion is generally dimensioned to be operatively received by the first body portion (e.g., cooperative sliding engagement for/between the guide(s) and the guideway(s)). Moreover, the mullion receiving element of the second body portion is configured and dimensioned to generally mimic that of the second mullion receiving element of the first body portion (i.e., in relation to the element per se, and in relation to its depending relationship with its adjacent structure, namely the first mullion receiving element or base as the case may be.

Figure 13:
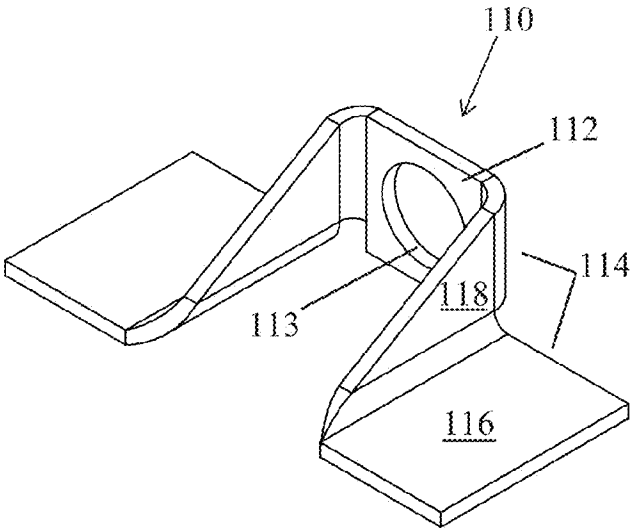
FIG. 13 substantially depicts a tensioner guide or retainer of the first and second device body portions of FIG. 2.
Figure 17:
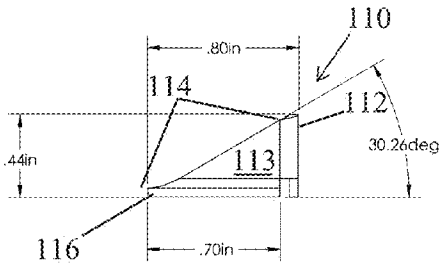
FIG. 17 depicts the FIG. 13 element in front elevation.
Figure 15:
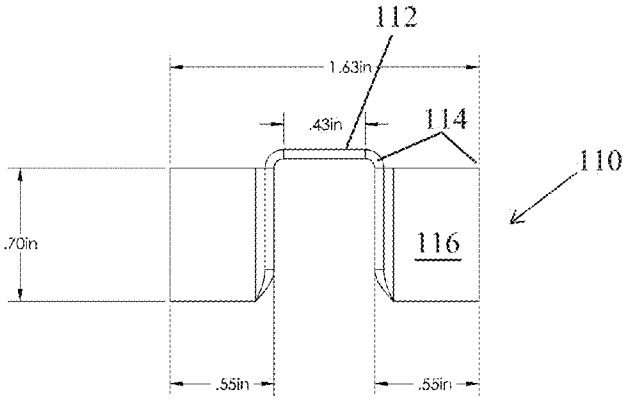
FIG. 15 depicts the FIG. 13 element in plan.
Figure 16:
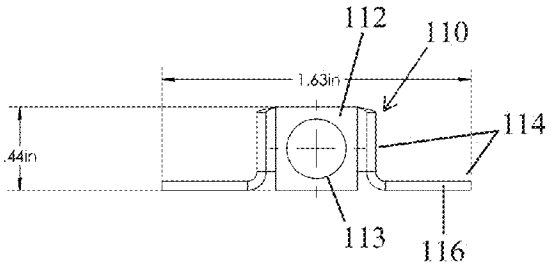
FIG. 16 depicts the FIG. 13 element in side elevation.

Referring now generally to FIG. 13, there is generally shown advantageous tensioner guide 110 in the context of the previously described device body portions. Further depictions are provided in FIGS. 15-17. The tensioner guide 110 includes an apertured guide member 112 vertically oriented via its opposing edges by supports 114 characterized by flange 116 and gusset 118 portions. As indicated with reference to FIG. 14, the guide is preferably a unitary structure.

Generally, each of the device body portions are equipped, as by a weldment or the like, with the illustrated tensioner guide, or adaptation thereof (FIG. 1 or 2). Notionally, the tensioner, e.g., a threaded bolt with finger hold as shown, is receivable in and through aperture 113 of the apertured guide member 112 of the tensioner guide 110 of the second body portion 80 for operative receipt in an adapted guide 110' of the first body portion (FIG. 2). The adapted guide 110' of the first body portion 40 advantageously, but not necessarily includes a captive nut 120 for threaded receipt of a free end of the tensioner, i.e., the captive nut overlies the aperture and registers therewith.

With an initial threaded engagement of the tensioner and registration of the guide(s) and guideway(s), the second body portion is slidingly translatable with respect to the first body portion, and the tensioner. With a crotch of the first body portion positioned at a mullion corner (i.e., the first mullion receiving portion upon a mullion face and the second mullion receiving element upon an adjacent mullion face), the body portions may be drawn together into clamping engagement with the mullion via advancement of the tensioner in relation to the tensioner anchor of the first body portion. Thereafter, a sign is readily and quickly affixed to the sign support structure of the device via an interference/mechanical interface. Having sufficiently secured to the device to the mullion, signs may be easily changed out or substituted at will.

Figure 21:
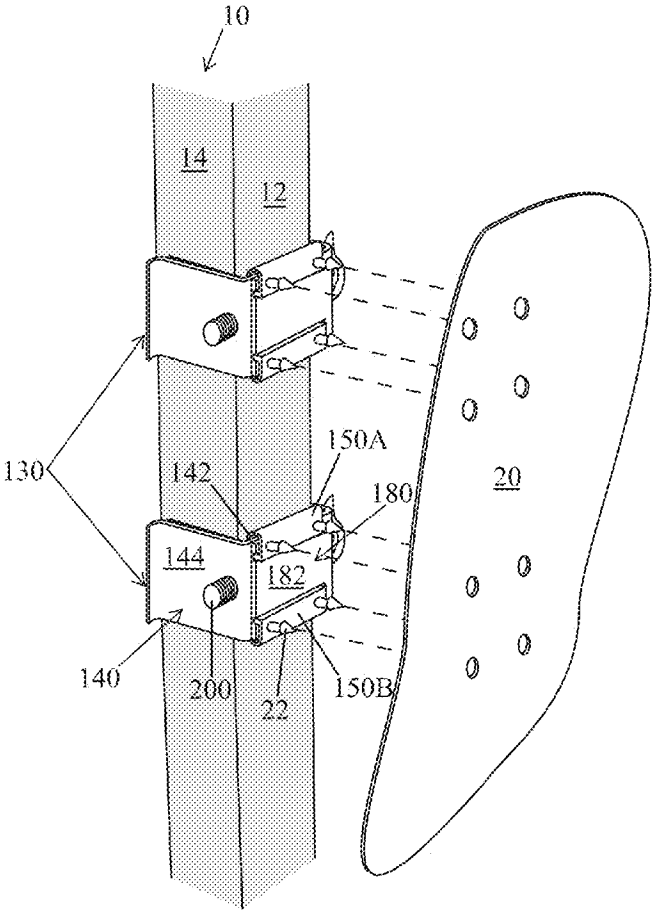
FIG. 21 depicts a pair of spaced apart FIG. 18 devices in operative combination with a window mullion, a sign portion indicated for support and retention by the device pair.
Figure 20:
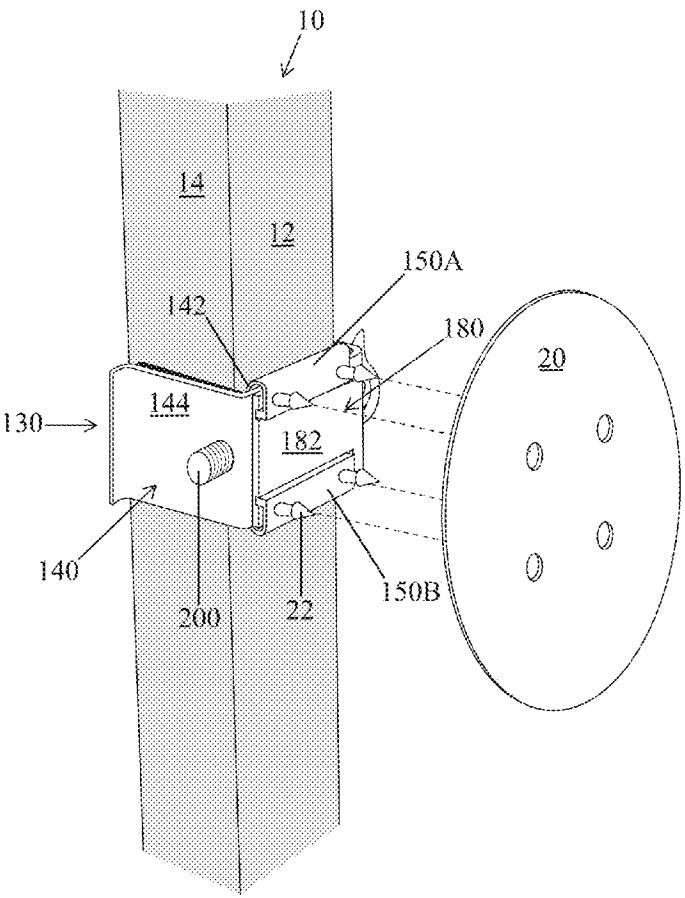
FIG. 20 depicts the device of FIG. 18 in operative combination with a window mullion, a sign indicated for support and retention thereby.

With reference now to FIGS. 18-21, a non-limiting alternate device 130 for securing a sign to a mullion is shown in assembled and unassembled states (FIGS. 18 & 19), and affixed to a window mullion 10 for receipt of a sign 20 as indicated in each of FIGS. 20 & 21. The illustrated device includes first 140 and second 180 device body portions and a tensioner 210 for operative union of the portions about mullion 10.

In connection to the contemplated assemblies of FIGS. 20 & 21, while a "Christmas tree" type fasteners 22 are shown, pins, locking pins, clips, rivets, etc. are believed suitable for securing the sign to the device, with selection somewhat predicated upon indoor versus outdoor applications. Moreover, while signage specifications may vary, a litho print to 24-48 point board is believed advantageous for indoor applications, with styrene or coroplast signage for outdoor applications. Finally, it is further contemplated that the device may be suitably fabricated from milled aluminum and/or powder coated metal.

The first device body portion 140 includes a first mullion receiving element 142, a second mullion receiving element 144, and sign support structures 146*a*, 146*b*. The first mullion receiving element 142 is positioned for receipt at a mullion face 12 (FIG. 20). The second mullion receiving element 144 of the adjacent mullion receiving elements extends from the first mullion receiving element 142 for tensioned engagement with a first lateral mullion surface 14 of opposingly paired lateral mullion surfaces adjacent mullion face 12 (FIG. 20). The sign support structures 146*a*, 146*b*, each of which includes a sign receiving element 150 (150*a*, 150*b*), are spaced apart and extend from the first mullion receiving element 142 so as to thereby delimit channels or guideways 152*a*, 152*b*, passing between sign receiving elements 150*a*, 150*b* of the sign support structures 146*a*, 146*b* and the first mullion receiving element 142, for sliding receipt of the second device portion 180.

The second body portion 180 is slidingly receivable within the channels or guideways 152*a*, 152*b* of the first device body portion 140 in furtherance of selectively positioning same in relation thereto and securing the body portions about the mullion. The second device body portion 180 comprises a base 182 from which extends a mullion receiving element 184 for tensioned engagement with a second lateral mullion surface (not visible) of opposingly paired lateral mullion surfaces adjacent mullion face 10. An exterior surface of base 182 of the second body portion 180 includes slots 183, namely, keyways, for receipt of "keys" of a portion of the guideways of the first device body portion, namely, the channels or guideways 152*a*, 152*b* include a depending rim 153 (153*a*, 153*b*) which functions as a key in relation to a keyway of the base of the second body portion.

Lateral mullion receiving elements of each of the device portions are adapted to permit passage of the tensioner in furtherance of uniting the portions. Advantageously, the lateral mullion receiving element 144 of the first body portion 140 includes a threaded aperture 145, i.e., a tensioner anchor, for threaded receipt of the free end of the tensioner 210 while the lateral mullion receiving element 184 of the second body portion 180 includes an aperture (not visible) which functions to guide and facilitate registration of the tensioner with the anchor. Via the subject configuration, the tensioner 210 is positioned intermediate the mullion face 12 and the first mullion receiving surface 142 of the first device body portion 140 in contrast to the device earlier described wherein the tensioner is intermediate the clamping portions of the device and the sign receiving element of the sign support structure.

Figure 23:
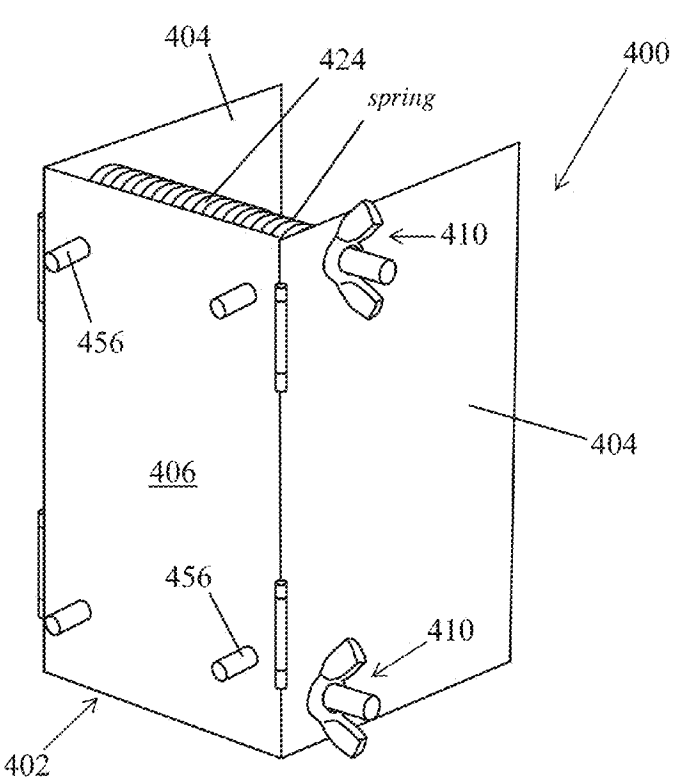
FIG. 23 depicts, front perspective view, a further alternate non-limiting device embodiment characterized by pivotable body portions.
Figure 24:
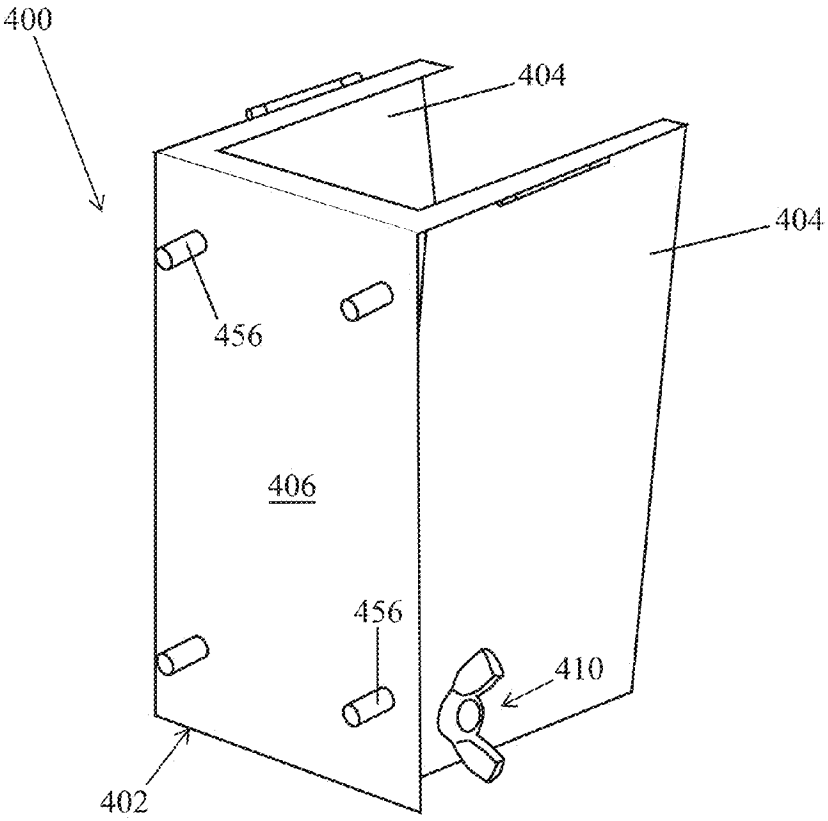
FIG. 24 depicts, front perspective view, a further alternate non-limiting device embodiment relative to the device of FIG. 23; and, FIG. 25 depicts, front perspective view, a further alternate non-limiting device embodiment characterized by a unitary body.

With reference now to FIGS. 22-25, several alternate, non-limiting device embodiments are provided. A further unitable device is generally provided (FIG. 22), with devices having a body adapted to have a portion or portions selectively manipulated to engage a mullion are likewise provided (FIGS. 23 & 24). Finally, an adapted unitary spring clip is generally provided as per the device of FIG. 25.

Figure 22:
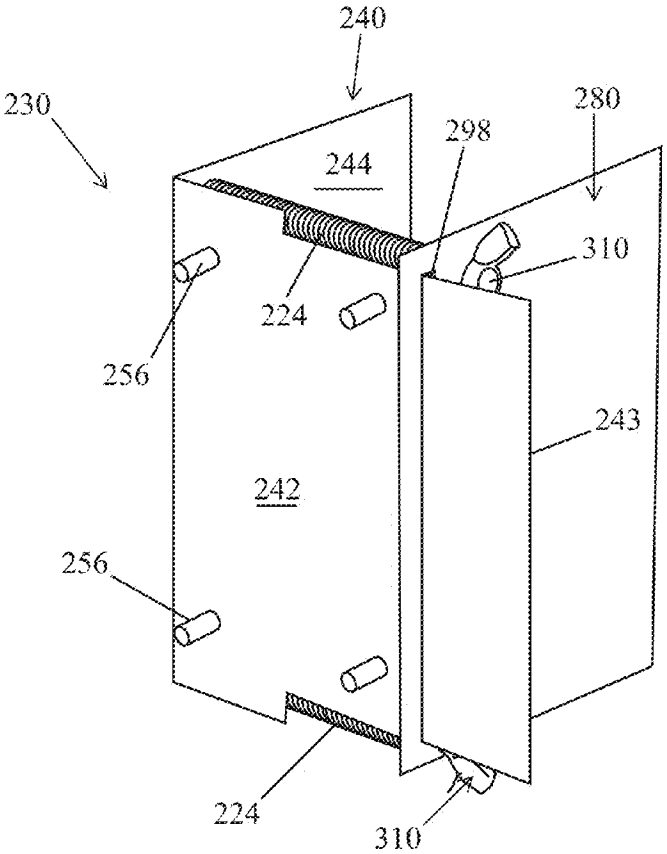
FIG. 22 depicts, front perspective view, a further alternate non-limiting device embodiment characterized by first and second body portions.

With reference now to FIG. 22, the contemplated device 230 includes first 240 and second 280 body portions, second body portion 280 being translatable in relation to first body portion 240 in furtherance of securing the device to a mullion. The first body portion 240 generally includes adjacent mullion receiving elements, namely, a face receiving element 242 and a lateral side receiving element 244, the mullion face receiving element 242 adapted to include sign fastening elements 256. The second body portion 280 is a mullion receiving element, namely, a lateral side receiving element, which includes a slot 298 through which a free edge 243 of the face receiving element 242 of the first body portion 240 passes and is passable. Upper and lower tensioners 310, passing through a resilient element 224 (e.g., a spring), operatively unite the body portions, and upon advancement of the tensioners, the outward spring tension is overcome and the second body portion is drawn toward the first body portion in furtherance of clamping engagement of the device about a mullion.

With reference now to FIGS. 23 & 24, each of the contemplated devices 400 comprise a body 402 having pivotable elements 404, e.g., panels, more particularly, opposing pivotable panels. The panels 404 are generally hingedly supported by the device body or portions thereof. Intermediate pivotable panels 404 is a sign support panel 406 advantageously adapted to include sign fastening elements 456. One or more tensioners 410, passing through a resilient element 424 (e.g., a spring), operatively unite pivotable panels 404, and upon advancement of the tensioner(s) 410, the outward spring tension is overcome, with the panels drawn together in furtherance of clamping engagement of the device about a mullion.

Figure 25:
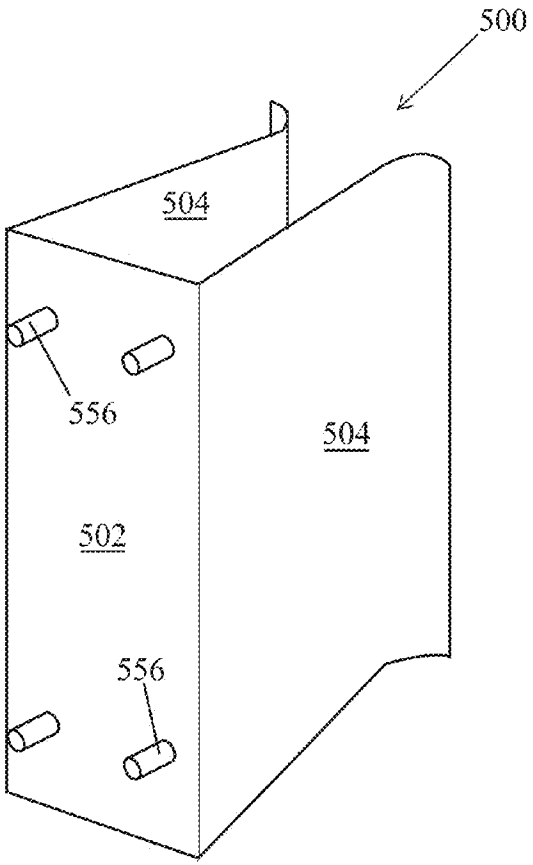

Finally, with reference now to FIG. 25, an adapted spring clip 500 is generally provided. The device 500 includes of a web 502, adapted to include sign fastening elements 556, from which extends opposing convergent panels 504 for tensioned engagement with opposed lateral surfaces of a mullion.

Since the structures of the assemblies, subassemblies, and/or mechanisms disclosed herein may be embodied in other specific forms without departing from the spirit or general characteristics thereof, some of which forms have been indicated, the embodiments described and depicted herein/with are to be considered in all respects illustrative and not restrictive. Moreover, while nominal processing has been described and detailed, and to some degree alternate work pieces and systems, assemblies, etc. with regard thereto referenced, contemplated processes are not so limited. Accordingly, the scope of the subject invention is as defined in the language of the appended claims, and includes not insubstantial equivalents thereto.

That which is claimed:

1. A device for securing a sign to a mullion, said device comprising:

a. a first device body portion characterized by adjacent mullion receiving elements and a sign support structure, a first mullion receiving element of said adjacent mullion receiving elements comprising a substantially planar member receivable adjacent a mullion face, a second mullion receiving element of said adjacent mullion receiving elements extending from said first mullion receiving element for tensioned engagement with a first lateral mullion surface of opposingly paired lateral mullion surfaces adjacent the mullion face, said sign support structure spaced apart and extending from said first mullion receiving element so as to thereby delimit a channel passing between said sign support structure and said first mullion receiving element;

b. a second device body portion slidingly receivable within said channel of said first device body portion, said second device body portion characterized by a mullion receiving element, extending from a base of said second device body portion, for tensioned engagement with a second lateral mullion surface of opposingly paired lateral mullion surfaces adjacent the mullion face; and, c. a tensioner operatively uniting said second device body portion to said first device body portion for drawing said mullion receiving element of said second device portion towards said second mullion receiving element of said first device body portion in furtherance of securing the device to the mullion, a sign receiving element adapted to receive a sign for support upon said sign support structure.

2. The device of claim 1 wherein said second mullion receiving element of said first device body portion extends at an acute angle from said first mullion receiving element thereof.

3. The device of claim 1 wherein said second mullion receiving element of said first device body portion extends from said first mullion receiving element thereof at an angle within a range of about 75-85°.

4. The device of claim 1 wherein said second mullion receiving element of said first device body portion extends from said first mullion receiving element thereof at an angle of about 80°.

5. The device of claim 1 wherein said mullion receiving element of said second device body portion extends at an acute angle from said base thereof.

6. The device of claim 1 wherein said mullion receiving element of said second device body portion extends from said base thereof at an angle within a range of about 75-85°.

7. The device of claim 1 wherein said mullion receiving element of said second device body portion extends from said base thereof at an angle of about 80°.

8. The device of claim 1 wherein said second mullion receiving element of said first device body portion and said mullion receiving element of said second device body portion extend at acute angles from said first mullion receiving element of said first device body portion and said base of said second device body portion respectively.

9. The device of claim 1 wherein said base of second device body portion includes opposing in-turned side edges, relative to each other, which, in combination, delimit a guide receivable in said channel of said first device body portion.

10. The device of claim 1 wherein said sign support structure includes a sign receiving element, said sign receiving element in a spaced apart elevated condition relative to said channel of said first device body portion.

11. The device of claim 1 wherein one of said first and second device body portions further includes a tensioner guide and the other of said first and second device body portions further includes a tensioner anchor.

12. The device of claim 1 wherein said tensioner traverses said first and second device body portions exterior of said first mullion receiving element of said first device body portion and said base of said second device body portion.

13. The device of claim 1 wherein said tensioner traverses said first and second device body portions interior of said first mullion receiving element of said first device body portion and said base of said second device body portion.

14. The device of claim 1 wherein said tensioner comprises a bolt.

15. The device of claim 1 wherein said second mullion receiving element of said first device body portion and said mullion receiving element of said second device body portion include a resilient layer or coating.

16. The device of claim 1 wherein said second mullion receiving element of said first device body portion and said mullion receiving element of said second device body portion each include an angularly outwardly projecting free end segment.

17. The device of claim 1 wherein said second mullion receiving element of said first device body portion and said mullion receiving element of said second device body portion each include an angularly outwardly projecting free end segment, said segment projecting at an angle of about 140°.

18. The device of claim 1 in operative combination with a sign, said sign secured to said sign receiving element of said sign support structure.

* * * * *